US008477091B2

(12) United States Patent
Kita

(10) Patent No.: US 8,477,091 B2
(45) Date of Patent: Jul. 2, 2013

(54) INFORMATION OUTPUT UNIT AND ELECTRONIC APPARATUS

(75) Inventor: Tatsuya Kita, Osaka (JP)

(73) Assignee: Funai Electric Co., Ltd., Osaka (JP)

( * ) Notice: Subject to any disclaimer, the term of this patent is extended or adjusted under 35 U.S.C. 154(b) by 1040 days.

(21) Appl. No.: 12/010,384

(22) Filed: Jan. 24, 2008

(65) Prior Publication Data

US 2008/0180368 A1 Jul. 31, 2008

(30) Foreign Application Priority Data

Jan. 25, 2007 (JP) ..... 2007-014440

(51) Int. Cl.
*G09G 5/02* (2006.01)

(52) U.S. Cl.
USPC ..... 345/89; 345/690; 345/204; 345/1.1; 348/674

(58) Field of Classification Search
USPC . 345/89, 95, 98, 168, 204, 1.1; 348/674–677, 348/690, 761
See application file for complete search history.

(56) References Cited

U.S. PATENT DOCUMENTS

| | | | | |
|---|---|---|---|---|
| 5,710,948 | A * | 1/1998 | Takagi | 396/50 |
| 6,340,996 | B1 | 1/2002 | Nakamura | 348/675 |
| 2005/0253827 | A1 | 11/2005 | Hung et al. | 345/204 |
| 2005/0285952 | A1* | 12/2005 | Kwon et al. | 348/234 |

FOREIGN PATENT DOCUMENTS

| | | |
|---|---|---|
| JP | 10-309274 | 11/1998 |
| JP | 10-333648 | 12/1998 |
| JP | 2002-057959 | 2/2002 |
| JP | 2005-326856 | 11/2005 |

* cited by examiner

*Primary Examiner* — Lun-Yi Lao
*Assistant Examiner* — Shaheda Abdin
(74) *Attorney, Agent, or Firm* — Morgan, Lewis & Bockius LLP

(57) ABSTRACT

An information output unit according to the present invention includes a first-gamma-correction-information storing unit that stores gamma correction information suitable for display of an image by a first liquid crystal display unit, a gamma correction unit that applies gamma correction based on the gamma correction information stored in the first-gamma-correction-information storing unit to inputted image information and outputs obtained image information to the liquid crystal display unit, a second gamma-correction-information storing unit that stores, when gamma correction is applied to the image information outputted by the gamma correction unit, gamma correction information for obtaining image information suitable for display of an image by a second liquid crystal display unit, and a control unit that outputs the gamma correction information stored in the second-gamma-correction-information storing unit to the liquid crystal display unit. Therefore, it is possible to obtain an information output unit that can make it unnecessary to perform operation in replacing a liquid crystal display unit and can prevent an increase in size of an apparatus, an increase in power consumption, and the like.

8 Claims, 2 Drawing Sheets

INFORMATION OUTPUT UNIT AND ELECTRONIC APPARATUS

CROSS-REFERENCE TO RELATED APPLICATIONS

This application is based on Japanese Patent Application No. 2007-014440 filed on Jan. 25, 2007, and the contents of which are hereby incorporated by reference.

BACKGROUND OF THE INVENTION

1. Field of the Invention

The present invention relates to an information output unit that outputs information to a liquid crystal display unit and an electronic apparatus including such an information output unit.

2. Description of the Related Art

In recent years, as represented by a cellular phone, an electronic apparatus including an information output unit that outputs information to the liquid crystal display unit and a liquid crystal display unit that displays an image based on the information inputted by the information output unit is widely used. In this specification, the liquid crystal display unit includes an LCD (Liquid Crystal Display) panel, a source driver, and a gate driver and displays the image based on the information inputted by the information output unit.

Since a gamma characteristic (a characteristic representing a relation between a gradation voltage and luminance of an LCD) of the LCD panel is different for each type of the LCD panel, in displaying an image using the liquid crystal display unit, it is necessary to apply gamma correction suitable for the LCD panel in use to original image information. Therefore, in replacing the type of the LCD panel of the liquid crystal display unit with another type, it is necessary to change a setting concerning gamma correction.

In the past, when the type of the LCD panel of the liquid crystal display unit is replaced with another type, the setting concerning gamma correction is changed by performing operation such as replacement of a ROM and readjustment of a circuit of the liquid crystal display unit. However, these kinds of operation are extremely complicated. Thus, various inventions for solving this problem have been made. An example of the inventions is found in JP-A-10-333648 (hereinafter, "Patent Document 1").

Patent Document 1 discloses a liquid crystal display unit that can change gamma correction information according to an LCD panel by storing information concerning a reference voltage of a gamma correction circuit in a memory and extracting the information, and D/A-converting the information to generate the reference voltage.

In the electronic apparatus including the information output unit and the liquid crystal display unit, the liquid crystal display unit may be replaced. Some liquid crystal display unit displays an image based on image information inputted by the information output unit without applying gamma correction to the image information (hereinafter, "first liquid crystal display unit"). Another liquid crystal display unit displays an image based on image information inputted by the information output unit after applying gamma correction based on gamma correction information inputted by the information output unit to the image information (hereinafter, "second liquid crystal display unit").

Therefore, when the information output unit is connected to the first liquid crystal display unit, the information output unit needs to apply gamma correction suitable for display of an image by the first liquid crystal display unit to an original image information and output image information obtained after gamma correction. On the other hand, when the information output unit is connected to the second liquid crystal display unit, the information output unit needs to output original image information and gamma correction information suitable for display of an image by the second liquid crystal display unit. In other words, information that the information output unit needs to output is different when the information output unit is connected to the first liquid crystal display unit and when the information output unit is connected to the second liquid crystal display unit.

Therefore, in the past, the information output unit changes, by performing replacement of a ROM, readjustment of a circuit, and the like, information to be outputted or changes information to be outputted in terms of software. In this way, the information output unit can output information to the liquid crystal display unit connected to the information output unit regardless of whether the liquid crystal display unit is the first liquid crystal display unit or the second liquid crystal display unit.

However, when the information output unit changes, by performing replacement of a ROM, readjustment of a circuit, and the like, information to be outputted, operation in replacing the liquid crystal display unit is extremely complicated. When the information output unit changes information to be outputted in terms of software, a large-capacity memory, a large number of D/A converters, and the like are necessary. Therefore, for example, a size of an apparatus is increased and power consumption is increased because of complication of a software routine.

The invention disclosed in Patent Document 1 can make it unnecessary to perform operation in replacing a type of the LCD panel of the liquid crystal display unit. Nevertheless, the invention cannot solve the problems of the information output unit connectable to both the first liquid crystal display unit and the second liquid crystal display unit.

SUMMARY OF THE INVENTION

The present invention has been devised in order to solve the problems described above and it is an object of the present invention to provide an information output unit that is connectable to both a liquid crystal display unit, which displays an image based on inputted image information without applying gamma correction to the image information, and a liquid crystal display unit, which displays an image based on inputted image information after applying gamma correction based on inputted gamma correction information to the image information, and outputs image information to the liquid crystal display units. The information output unit can make it unnecessary to perform operation in replacing the liquid crystal display unit and can prevent an increase in size of an apparatus, an increase in power consumption, and the like. It is another object of the present invention to provide an electronic apparatus including such an information output unit.

In order to attain the objects, an information output unit according to the present invention is an information output unit that is connected to any one of a first liquid crystal display unit, which displays an image based on inputted image information without applying gamma correction to the image information, and a second liquid crystal display unit, which displays an image based on inputted image information after applying gamma correction based on gamma correction information to the image information, and outputs image information to the liquid crystal display unit connected to the information output unit. The information output unit includes a first-gamma-correction-information storing unit that stores first gamma correction information used for gamma correction applied to image information, a second-gamma-correction-information storing unit that stores second gamma correction information used for gamma correction applied to image information, a gamma correction unit that outputs, after applying gamma correction based on the first gamma correction information to inputted image information (hereinafter, "input image information") to thereby change the input image information to corrected image information, the corrected image information to the liquid crystal display unit connected to the information output unit, and a control unit that outputs the second gamma correction information to the liquid crystal display unit connected to the information output unit.

More specifically, when the first gamma correction information is used for gamma correction applied to the input image information, the first gamma correction information may change the input image information to image information suitable for display of an image by the first liquid crystal display unit. When the second gamma correction information is used for gamma correction applied to the corrected image information, the second gamma correction information may change the corrected image information to image information suitable for display of an image by the second liquid crystal display unit.

According to this constitution, the corrected image information applied with gamma correction based on the first gamma correction information and the second gamma correction information are outputted to the liquid crystal display unit connected to the information output unit. Therefore, when the first liquid crystal display unit is connected to the information output unit, the first liquid crystal display unit can display an image based on the corrected image information. When the second liquid crystal display unit is connected to the information output unit, the second liquid crystal display unit can display, after applying gamma correction based on the second gamma correction information to the corrected image information, an image based on the corrected image information.

As a result, regardless of whether the first liquid crystal display unit or the second liquid crystal display unit is connected to the information output unit, the information output unit can cause the liquid crystal display unit connected to the information output unit to display an appropriate image (an image based on image information applied with appropriate gamma correction).

In the constitution described above, the control unit may output control information for controlling various operations of the liquid crystal display units to the liquid crystal display unit connected to the information output unit and output the second gamma correction information to the liquid crystal display unit using a free address of the control information.

According to this constitution, it is unnecessary to provide a new information line between the information output unit and the liquid crystal display units and it is possible to prevent an increase in size of an apparatus, an increase in power consumption, and the like.

An electronic apparatus according to the present invention includes the information output unit having the constitution and the first liquid crystal display unit connected to the information output unit. In this constitution, the first liquid crystal display unit may be inputted with the corrected image information from the information output unit and display an image on the basis of the corrected image information.

An electronic apparatus according to the present invention includes the information output unit having the constitution and the second liquid crystal display unit connected to the information output unit. In this constitution, the second liquid crystal display unit may be inputted with the corrected image information and the second gamma correction information from the information output unit and display, after further applying gamma correction based on the second gamma correction information to the corrected image information to thereby change the corrected image information to re-corrected image information, an image on the basis of the re-corrected image information.

An information output unit according to the present invention is an information output unit that is connected to a liquid crystal display unit, which displays an image on the basis of inputted image information, and outputs information to the liquid crystal display unit connected to the information output unit. The information output unit is connectable to both a first liquid crystal display unit, which displays an image based on inputted image information without applying gamma correction to the image information, and a second liquid crystal display unit, which displays an image based on inputted image information after applying gamma correction based on inputted gamma correction information to the image information. The information output unit includes a first-gamma-correction-information storing unit that stores gamma correction information suitable for display of an image by the first liquid crystal display unit, a gamma correction unit that applies gamma correction based on the gamma correction information stored in the first-gamma-correction-information storing unit to inputted image information and outputs obtained image information to the liquid crystal display unit, a second gamma-correction-information storing unit that stores, when gamma correction is applied to the image information outputted by the gamma correction unit, gamma correction information for obtaining image information suitable for display of an image by the second liquid crystal display unit, and a control unit that outputs the gamma correction information stored in the second-gamma-correction-information storing unit to the liquid crystal display unit.

In the information output unit having this constitution, the control unit may output control information for controlling various operations of the liquid crystal display unit to the liquid crystal display unit connected to the information output unit and output the gamma correction information stored in the second-gamma-correction-information storing unit to the liquid crystal display unit using a free address of the control information.

DESCRIPTION OF THE DRAWINGS

The above-mentioned and other objects and characteristics of the present invention will be clearer by referring to the following description about preferred embodiments and attached drawings described below.

DESCRIPTION OF THE PREFERRED EMBODIMENTS

An embodiment of the present invention will be hereinafter explained with reference to the accompanying drawings.

Figure 1:
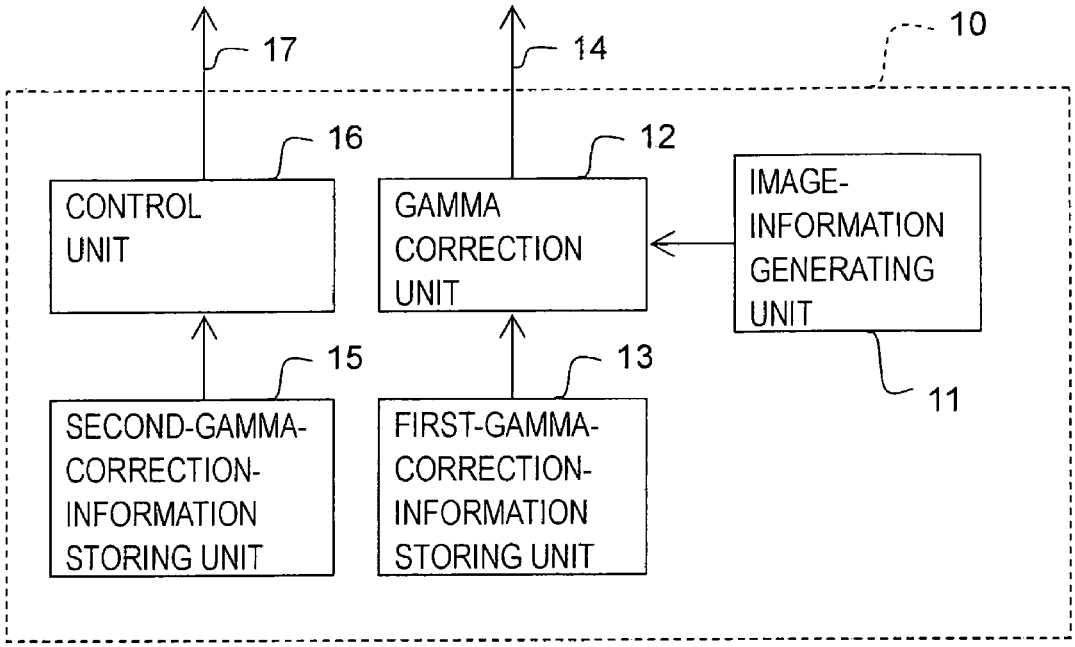
FIG. 1 is a block diagram showing the schematic structure of an information output unit 10.

First, an information output unit 10 according to the embodiment of the present invention is explained. FIG. 1 is a block diagram showing the schematic structure of the information output unit 10. The information output unit 10 includes an image-information generating unit 11, a gamma correction unit 12 connected to the image-information generating unit 11, a first-gamma-correction-information storing unit 13 connected to the gamma correction unit 12, an information line 14 connected to the gamma correction unit 12, a second-gamma-correction-information storing unit 15, a control unit 16 connected to the second-gamma-correction-information storing unit 15, and an information line 17 connected to the control unit 16. A liquid crystal display unit (a first liquid crystal display unit or a second liquid crystal display unit described later) is connected to the information output unit 10.

Operations performed by the information output unit 10 in outputting information to the liquid crystal display unit connected thereto are explained. First, the image-information generating unit 11 generated image information. For example, when the information output unit 10 is built in a digital camera, the image-information generating unit 11 includes an imaging optical system OS and a CCD (Charge Coupled Device) and generates various kinds of image information for red (R), green (G), and blue (B).

The gamma correction unit 12 is inputted with the image information generated by the image-information generating unit 11. Gamma correction is not applied to the inputted image information (hereinafter, "input image information") yet. The first-gamma-correction-information storing unit 13 has stored therein gamma correction information (first gamma correction information) used for gamma correction.

The first gamma correction information is set such that the input image information is corrected to image information suitable for image display by a first liquid crystal display unit 20 described later. When gamma correction employing the first gamma correction information is applied to the input image information, the input image information changes to image information suitable for display of an image by the first liquid crystal display unit 20 (hereinafter, "corrected image information").

The gamma correction unit 12 reads out the first gamma correction information from the first-gamma-correction-information storing unit 13 and applies gamma correction employing the first gamma correction information to the input image information. Consequently, the input image information is corrected to corrected image information. Thereafter, the gamma correction unit 12 outputs, through the information line 14, the corrected image information to the liquid crystal display unit connected to the information output unit 10.

The second-gamma-correction-information storing unit 15 has stored therein gamma correction information (second gamma correction information) used for gamma correction. The gamma correction information is set such that the corrected image information is corrected to image information suitable for display of an image by a second liquid crystal display unit 30 described later. When gamma correction employing the second gamma correction information is further applied to the corrected image information, the corrected image information changes to image information suitable for display of an image by the second liquid crystal display unit 30 (hereinafter, "re-corrected image information").

The control unit 16 reads out the second gamma correction information from the second-gamma-correction-information storing unit 15 and outputs, through the information line 17, the second gamma correction information to the liquid crystal display unit connected to the information output unit 10 together with control information for controlling various operations of the liquid crystal display unit.

The control unit 16 outputs the second gamma correction information to the liquid crystal display unit connected to the information output unit 10 using a free address of the control information. The control information for controlling various operations of the liquid crystal display unit connected to the information output unit 10 includes source driver control information, gate driver control information, and power on/off command information.

Figure 2:
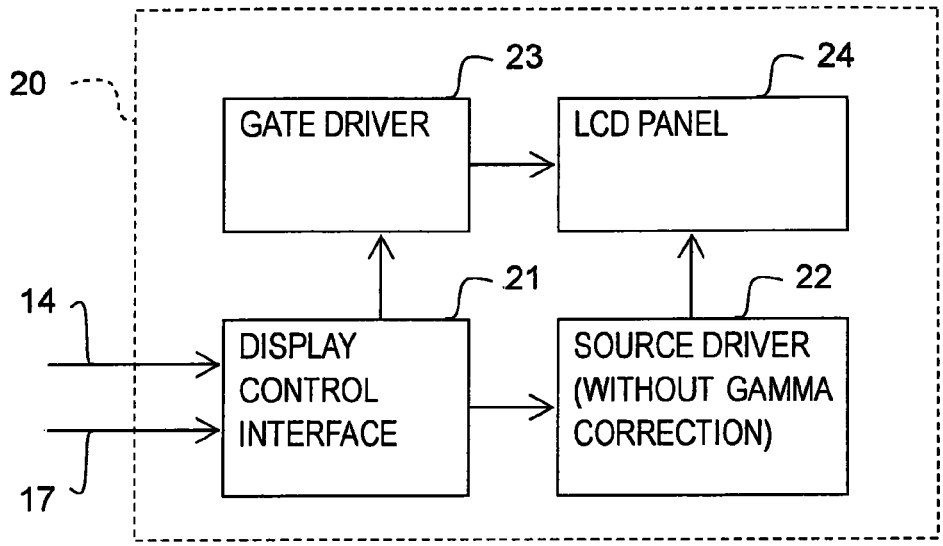
FIG. 2 is a block diagram showing the schematic structure of a first liquid crystal display unit 20.

The first liquid crystal display unit 20 according to this embodiment is explained. FIG. 2 is a block diagram showing the schematic structure of the first liquid crystal display unit 20 according to this embodiment. The first liquid crystal display unit 20 includes a display control interface 21 connected to the information line 14 and the information line 17, a source driver 22 connected to the display control interface 21, a gate driver 23 connected to the display control interface 21, and an LCD panel 24 connected to the source driver 22 and the gate driver 23.

The first liquid crystal display unit 20 is connected to the information output unit 10 and displays an image based on image information inputted from the information output unit 10. Operations in this case are explained. First, the corrected image information is inputted to the display control interface 21 through the information line 14 and the control information for controlling various operations of the first liquid crystal display unit 20 and the second gamma correction information are inputted to the display control interface 21 through the information line 17.

The display control interface 21 outputs the corrected image information inputted through the information line 14 and the source driver control information inputted through the information line 17 to the source driver 22. The display control interface 21 outputs the gate driver control information inputted through the information line 17 to the gate driver 23.

The source driver 22 applies various kinds of signal processing such as D/A conversion to the corrected image information inputted from the display control interface 21. It is assumed that the source driver 22 does not have a function of applying gamma correction.

The source driver 22 outputs the image information, which is subjected to the various kinds of signal processing, to the LCD panel 24 on the basis of the source driver control information inputted from the display control interface 21. The gate driver 23 outputs scanning information to the LCD panel 24 on the basis of the gate driver control information inputted from the display control interface 21.

According to the operations described above, an image based on the corrected image information inputted to the display control interface 21 through the information line 14 is displayed on the LCD panel 24. In short, the first liquid crystal display unit 20 displays the image based on the inputted corrected image information without applying gamma correction to the image information.

However, as described above, the corrected image information is already subjected to gamma correction based on the first gamma correction information by the gamma correction unit 12 of the information output unit 10. Therefore, even if processing of gamma correction is not applied to the corrected image information by the first liquid crystal display unit 20, an image subjected to appropriate gamma correction is displayed on the LCD panel 24.

When the first liquid crystal display unit 20 is connected to the information output unit 10, the second gamma correction information inputted to the display control interface 21 through the information line 17 is not used.

Figure 3:
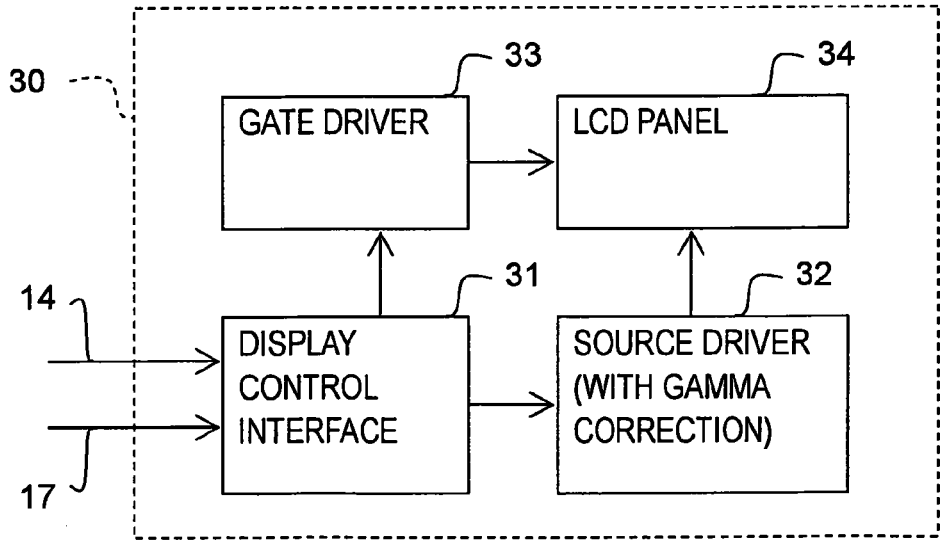
FIG. 3 is a block diagram showing the schematic structure of a second liquid crystal display unit 30.

The second liquid crystal display unit 30 according to this embodiment is explained. FIG. 3 is a block diagram showing the schematic structure of the second liquid crystal display unit 30 according to this embodiment. The second liquid crystal display unit 30 includes a display control interface 31 connected to the information line 14 and the information line 17, a source driver 32 connected to the display control interface 31, a gate driver 33 connected to the display control interface 31, and an LCD panel 34 connected to the source driver 32 and the gate driver 33.

The second liquid crystal display unit 30 is connected to the information output unit 10 and displays an image based on image information inputted from the information output unit 10. Operations in this case are explained. First, the corrected image information is inputted to the display control interface 31 through the information line 14 and the control information for controlling various operations of the second liquid crystal display unit 30 and the second gamma correction information are inputted to the display control interface 31 through the information line 17.

The display control interface 31 outputs the corrected image information inputted through the information line 14 and the source driver control information and the second gamma correction information inputted through the information line 17 to the source driver 32. The display control interface 31 outputs the gate driver control information inputted through the information line 17 to the gate driver 33.

The source driver 32 applies signal processing such as D/A conversion and applies gamma correction based on the second gamma correction information to the corrected image information to thereby change the corrected image information to re-corrected image information. The source driver 32 outputs the re-corrected image information to the LCD panel 34 on the basis of the source driver control information. The gate driver 33 outputs scanning information to the LCD panel 34 on the basis of the gate driver control information.

According to the operations described above, an image based on the re-corrected image information is displayed on the LCD panel 34. In other words, the second liquid crystal display unit 30 applied processing of gamma correction based on the inputted gamma correction information (second gamma correction information) to the inputted image information (corrected image information) to generate re-corrected image information and displays an image based on the re-corrected image information.

The corrected information is image information subjected to gamma correction based on the first gamma correction information by the gamma correction unit 12 of the information output unit 10. The second gamma correction information is gamma correction information for obtaining image information (re-corrected image information) suitable for display of an image by the second liquid crystal display unit 30 when gamma correction is applied to the corrected image information.

In other words, when gamma correction based on the second gamma correction information is further applied to the corrected image information (the image information subjected to gamma correction based on the first gamma correction information), re-corrected image information suitable for display of an image by the second liquid crystal display unit 30 is obtained. Therefore, an appropriate image is displayed on the LCD panel 34.

As explained above, the information output unit 10 according to this embodiment can display an appropriate image in any case without changing information to be outputted according to whether the first liquid crystal display unit 20 or the second liquid crystal display unit 30 is connected to the information output unit 10. Therefore, it is possible to make it unnecessary to perform, in replacing a liquid crystal display unit, extremely complicated operation required in the information output unit that changes, by performing replacement of a ROM, readjustment of a circuit, and the like, information to be outputted.

It is also possible to make it unnecessary to provide a large-capacity memory, a large number of D/A converters, and a complicated software routine required in the information output unit that changes information to be outputted in terms of software. Therefore, it is possible to prevent an increase in size of an apparatus, an increase in power consumption, and the like.

The control unit 16 outputs, through the information line 17, the second gamma correction information stored in the second-gamma-correction-information storing unit 15 to the liquid crystal display unit connected to the information output unit 10 using a free address of the control information for controlling the various operations of the liquid crystal display unit. Therefore, it is unnecessary to provide a new information line between the information output unit 10 and the liquid crystal display unit connected to the information output unit 10 and it is possible to prevent an increase in size of an apparatus, an increase in power consumption, and the like.

The present invention is not limited to the embodiment described above. Various modifications are possible without departing from the spirit of the present invention. For example, in the embodiment, the information output unit 10 generates image information with the image-information generating unit 11. However, naturally, it is also possible to provide the information output unit 10 that does not include the image-information generating unit 11 and is inputted with image information generated on the outside.

As explained above as the embodiment, the information output unit according to the present invention applies gamma correction based on the gamma correction information (the first gamma correction information) stored in the first-gamma-correction-information storing unit suitable for display of an image by the first liquid crystal display unit and outputs obtained image information to the liquid crystal display unit. Therefore, when the liquid crystal display unit connected to the information output unit is the first liquid crystal display unit that displays an image based on inputted image information without applying gamma correction to the image information, it is possible to cause the first liquid crystal display unit to perform appropriate image display.

When gamma correction is applied to the image information (the corrected image information) outputted from the gamma correction unit, the information output unit according to the present invention outputs, to the liquid crystal display unit, the gamma correction information (the second gamma correction information) stored in the second-gamma-correction-information storing unit for obtaining image information suitable for display of an image by the second liquid crystal display unit. Therefore, when the liquid crystal display unit connected to the information output unit is the second liquid crystal display unit that displays an image based on the inputted image information after applying gamma correction based on the inputted gamma correction information to the image information, it is possible to cause the second liquid crystal display unit to perform appropriate image display.

In other words, regardless of whether the information output unit according to the present invention is connected to the first liquid crystal display unit or the second liquid crystal display unit, the information output unit can cause the liquid crystal display unit to perform appropriate image display. Therefore, it is possible to make it unnecessary to perform extremely complicated operation in replacing the liquid crystal display unit required in the information output unit that changes, by performing replacement of a ROM, readjustment of a circuit, and the like, information to be changed.

It is also possible to make it unnecessary to provide a large-capacity memory, a large number of D/A converters, and a complicated software routine required in the information output unit that changes information to be outputted in terms of software. Therefore, it is possible to prevent an increase in size of an apparatus, an increase in power consumption, and the like.

In the information output unit according to the present invention, the control unit outputs the gamma correction information stored in the second-gamma-correction-information storing unit to the liquid crystal display unit using a free address of the control information for controlling various operations of the liquid crystal display unit connected to the information output unit. Therefore, it is unnecessary to provide a new information line between the information output unit and the liquid crystal display unit and it is possible to prevent an increase in size of an apparatus, an increase in power consumption, and the like.

What is claimed is:

1. An information output unit that is connected to anyone of a first liquid crystal display unit, which displays an image based on inputted image information without applying gamma correction to the image information, and a second liquid crystal display unit, which displays an image based on inputted image information after applying gamma correction based on gamma correction information to the image information, the information output unit comprising:

a first-gamma-correction-information storing unit that has stored therein first gamma correction information used for gamma correction applied to the image information; a second-gamma-correction-information storing unit that has stored therein second gamma correction information used for gamma correction applied to the first gamma corrected image information;

a gamma correction unit that performs a correction results output operation irrespective of which of the first and second liquid crystal display units in connected to the information output unit;

a control unit that outputs the second gamma correction information to either the first or second liquid crystal display unit connected to the information output unit irrespective of which of the first and second liquid crystal display units is connected to the information output unit wherein the correction result output operation comprises applying gamma correction based on the first gamma correction information to inputted image information to produce corrected image information and then outputting the corrected image information to the liquid crystal display unit connected to the connected information output unit, and wherein when the first liquid crystal display is connected to the information output unit, the first gamma correction information is used for gamma correction applied to the input image information, the first gamma correction information changes the input image information to image information suitable for display an image by the first liquid crystal display unit, and the second gamma correction information is not used for gamma correction, when outputted to the first liquid display unit, and wherein when the second liquid crystal display is connected to the information output unit, the second gamma correction information is used for gamma correction applied to the corrected image information, the second gamma correction information changes the corrected image information to image information suitable for display of an image by the second liquid crystal display unit.

2. An information output unit according to claim 1, wherein the control unit outputs control information for controlling various operations of the liquid crystal display unit connected to the information output unit to the liquid crystal display unit connected to the information output unit and outputs the second gamma correction information to the liquid crystal display unit connected to the information output unit using a free address of the control information.

3. An electronic apparatus according to claim 1, wherein the first liquid crystal display unit is inputted with the corrected image information from the information output unit and displays an image on the basis of the corrected image information.

4. An electronic apparatus according to claim 1, wherein the second liquid crystal display unit is inputted with the corrected image information and the second gamma correction information from the information output unit and displays, after further applying gamma correction based on the second gamma correction information to the corrected image information to thereby change the corrected image information to re-corrected image information, an image on the basis of the re-corrected image information.

5. An information output unit, being connectable to both a first liquid crystal display unit, which displays an image based on inputted image information without applying gamma correction to the image information, and a second liquid crystal display unit, which displays an image based on inputted image information after applying gamma correction based on inputted gamma correction information to the image information, the information output unit comprising:

a first-gamma-correction-information storing unit that stores gamma correction information suitable for display of an image by the first liquid crystal display unit;

a gamma correction unit performs a correction result output operation irrespective of which of the first and second liquid crystal display units is connected;

a second gamma-correction-information storing unit that stores, when gamma correction is applied to the image information outputted by the gamma correction unit, second gamma correction information for obtaining image information suitable for display of an image by the second liquid crystal display unit; and a control unit that outputs the gamma correction information stored in the second-gamma-correction-information storing unit to the liquid crystal display unit irrespective of which of the first and second liquid crystal display units is connected, wherein the correction result output operation comprises applying gamma correction based on the gamma correction information stored in first-gamma-correction information storing unit and not using the second gamma-correction information and then outputting obtained image information to the first liquid crystal display unit, and applying the second gamma correction information based on the second gamma correction information stored in the second gamma-correction-information storing unit and then outputting obtained image information to the second liquid crystal display unit.

6. An information output unit according to claim 5, wherein the control unit outputs control information for controlling various operations of the liquid crystal display unit connected to the information output unit to the liquid crystal display unit connected to the information output unit and outputs the gamma correction information stored in the second-gamma-correction-information storing unit to the liquid crystal display unit connected to the information output unit using a free address of the control information.

7. An information output unit comprising a first information line and a second information line, the first and second information lines having connected thereto alternatively either a first liquid crystal display unit, which displays an image based on inputted image information without applying gamma correction to the image information, or a second liquid crystal display unit, which displays an image based on inputted image information after applying gamma correction based on gamma correction information to the image information, the information output unit comprising:

a first-gamma-correction-information storing unit that has stored therein first gamma correction information used for gamma correction applied to the image information;

a second-gamma-correction-information storing unit that has stored therein second gamma correction information used for gamma correction applied to the image information;

a gamma correction unit that outputs, after applying gamma correction based on the first gamma correction information to inputted image information to thereby change the input image information to corrected image information via the first information line;

a control unit that outputs the second gamma correction information via the second information line, wherein when the first gamma correction information is used for gamma correction applied to the input image information, the first gamma correction information changes the input image information to image information suitable for display of an image by the first liquid crystal display unit, the second gamma correction information is, when the second liquid crystal display unit is connected to the second information line, outputted to the second liquid crystal display unit to be used for gamma correction performed by the second liquid crystal display unit, and when the second gamma correction information is used for gamma correction applied to the corrected image information, the second gamma correction information changes the corrected image information to image information suitable for display of an image by the second liquid crystal display unit.

8. An information system comprising:

a first liquid crystal display unit which displays an image based on inputted image information without applying gamma correction to the image information;

a second liquid crystal display unit which displays an image based on inputted image information after applying gamma correction based on gamma correction information to the image information; and an information output unit which can be connected to any of the first and second liquid crystal display units, the information system forming an electronic apparatus having any of a first configuration where the first liquid crystal display unit is connected to the information output unit and a second configuration where the second liquid crystal display unit is connected to the information output unit, wherein the information output unit comprises:

a first-gamma-correction-information storing unit that has stored therein first gamma correction information used for gamma correction applied to the image information;

a second-gamma-correction-information storing unit that has stored therein second gamma correction information used for gamma correction applied to the image information;

a gamma correction unit that performs a correction result output operation irrespective of which of the first and second liquid crystal display units is connected;

a control unit that outputs the second gamma correction information irrespective of which of the first and second liquid crystal display units is connected, wherein the correction result output operation comprises applying gamma correction based on the first gamma correction information to inputted image information (referred to as input image information) to produce corrected image information and then outputting the corrected image information to the liquid crystal display unit connected to the information output unit, when the first gamma correction information is used for gamma correction applied to the input image information, the first gamma correction information changes the input image information to image information suitable for display of an image by the first liquid crystal display unit, the second gamma correction information, when outputted to the first liquid crystal display unit, is not used and, when outputted to the second liquid crystal display unit, is used for gamma correction performed by the second liquid crystal display unit, and when the second gamma correction information is used for gamma correction applied to the corrected image information, the second gamma correction information changes the corrected image information to image information suitable for display of an image by the second liquid crystal display unit.

* * * * *